US011260258B2

(12) United States Patent
Simonson et al.

(10) Patent No.: US 11,260,258 B2
(45) Date of Patent: Mar. 1, 2022

(54) DUMBBELL WITH ROTATING GRIP

(71) Applicant: Eleiko Group AB, Halmstad (SE)

(72) Inventors: Roy Simonson, San Clement, CA (US); Camilla Schough, Gullbrandstorp (SE)

(73) Assignee: Eleiko Group AB, Halmstad (SE)

( * ) Notice: Subject to any disclaimer, the term of this patent is extended or adjusted under 35 U.S.C. 154(b) by 33 days.

(21) Appl. No.: 16/671,530

(22) Filed: Nov. 1, 2019

(65) Prior Publication Data

US 2020/0147442 A1 May 14, 2020

(30) Foreign Application Priority Data

Nov. 9, 2018 (SE) ..... 1851398-6

(51) Int. Cl.
*A63B 21/072* (2006.01)
*A63B 21/00* (2006.01)

(52) U.S. Cl.
CPC ..... *A63B 21/0726* (2013.01); *A63B 21/4035* (2015.10); *A63B 21/4043* (2015.10)

(58) Field of Classification Search
CPC ..... A63B 21/0004; A63B 21/0726; A63B 21/4035; A63B 21/4043; A63B 21/0728;
(Continued)

(56) References Cited

U.S. PATENT DOCUMENTS 2,678,802 A * 5/1954 Adams ..... F16K 3/30 251/328
5,078,392 A * 1/1992 Kracht ..... A63B 21/0728 482/107

(Continued)

FOREIGN PATENT DOCUMENTS

CN 204671805 U 9/2015
CN 206660427 U 11/2017

(Continued)

OTHER PUBLICATIONS

Engineering360 document (derived from: Engineering 360, "Wave Washers Information" [online], Feb. 2, 2018 [retrieved on Jan. 14, 2021], Retrieved from: https://web.archive.org/web/20180202031836/https://www.globalspec.com/learnmore/mechanical_components/springs/wave_washers) (Year: 2018).*

(Continued)

*Primary Examiner* — Joshua Lee
*Assistant Examiner* — Catrina A Letterman
(74) *Attorney, Agent, or Firm* — Tucker Ellis LLP

(57) ABSTRACT

A dumbbell having a shaft, first and second dumbbell heads, respectively fixedly connected to first and second ends of the shaft, a tube-shaped hollow grip rotatably arranged around the shaft having first and second ends. An inner diameter of the grip is greater than an outer cross-sectional dimension of the shaft. The dumbbell further having a first ball bearing and a second ball bearing, wherein an outer ring of the first ball bearing is connected to the first dumbbell head, and an inner ring of the first ball bearing is fixedly arranged to the first end of the hollow grip, and an outer ring of the second ball bearing is connected to the second dumbbell head, and an inner ring of the second ball bearing is fixedly arranged to the second end of the hollow grip.

11 Claims, 2 Drawing Sheets

(58) Field of Classification Search
CPC ..... A63B 21/072–078; A63B 21/16; A63B 21/4023; A63B 21/4033; A63B 23/035; A63B 23/03508; A63B 23/03516; A63B 23/12
See application file for complete search history.

(56) References Cited

U.S. PATENT DOCUMENTS

| | | | | |
|---|---|---|---|---|
| 7,491,156 | B1 * | 2/2009 | GaoYong | A63B 21/0724 482/106 |
| 10,335,628 | B1 * | 7/2019 | Scarpa | A63B 21/0618 |
| 2007/0287611 | A1 * | 12/2007 | Januszek | A63B 21/0728 482/107 |
| 2008/0070762 | A1 * | 3/2008 | White | A63B 23/1281 482/108 |
| 2010/0206142 | A1 * | 8/2010 | Sloane | B25G 1/105 81/489 |
| 2014/0274595 | A1 * | 9/2014 | Patti | A63B 21/4049 482/106 |
| 2015/0038303 | A1 * | 2/2015 | Adkins | A63B 21/0728 482/108 |
| 2015/0343255 | A1 * | 12/2015 | Miller | A63B 21/0724 482/104 |

FOREIGN PATENT DOCUMENTS

| | | | |
|---|---|---|---|
| CN | 207286547 | U | 5/2018 |
| CN | 202028101 | U | 11/2019 |
| DE | 102017003286 | A1 | 10/2018 |
| GB | 2422122 | A | 7/2006 |
| GB | 2487360 | A | 7/2012 |
| KR | 20120005422 | U | 7/2012 |

OTHER PUBLICATIONS

Engineering360 document (derived from: Engineering 360, "Wave Washers Information" [online], Feb. 2, 2018 [retrieved on Jan. 14, 2021], Retrieved from: https://web.archive.org/web/2018020231836/https://www.globalspec.com/learnmore/mechanical_components/springs/wave_washers) (Year: 2018).*
Engineering360 document was provided in the Non-Final Rejection dated Jan. 22, 2021 (Year: 2018).*
Swedish Search Report from corresponding Swedish Patent Application No. 1851398-6, dated May 22, 2019, 3 pages.

* cited by examiner

DUMBBELL WITH ROTATING GRIP

RELATED APPLICATION DATA

This application claims the benefit of Swedish Patent Application No. 1851398-6, filed on Nov. 9, 2018, the disclosure of which is incorporated herein by reference in its entirety.

TECHNICAL FIELD

The invention considers a dumbbell with a rotating grip.

BACKGROUND ART

Different kinds of dumbbells with a rotating grip or rotating weights are known, but they have a number of drawbacks.

One solution is presented in document KR20120005422U, which describes a dumbbell with rotatable weights. The dumbbell has a grip inside which a rotatable shaft extends, and the weights are attached to the rotatable shaft. The object of the invention is to provide vibrations in the dumbbell, which vibrations affects muscles in the body. The vibrations are achieved by that the weights rotates while the handle is moved to the right and left respectively forwards and backwards. The problem solved by this solution is another than the present invention solves, and the solution is complicated.

Another solution is presented in CN206660427U, which discloses a dumbbell with a rotatable shaft, arranged inside a grip. The ends of the shaft are connected to the dumbbell heads by threaded connection, and a plurality of bearings are arranged along the outside of the shaft to connect the outside of the shaft with the inside of the grip, whereby the shaft is rotatable inside the grip. Further, a gasket is provided between the grip and the dumbbell heads. The purpose of the invention is to avoid injuries on the human wrist and elbow joint. This solution is not a premium solution and will have problems over time due to a design affected by external shock forces and the like.

There are a number of other solutions on the market, with or without patent protection. Some problems of prior art solutions concern the life time of the dumbbell, especially with remained high-end feeling of the rotating grip. The rotating grip is normally negatively affected by shock forces and the like, which is common in the daily use of dumbbells, since prior art solutions often are designed with contact between the shaft and the rotating grip, like the Korean patent presented above. One problem with prior art solutions related to this is that the grip, especially in the premium segment of dumbbells, is made rather thick, to take care of the shock forces, and this together with the constructional design of the rotating grip makes the total cross-section of the grip part large. A thin grip fits all users, but it is a problem in prior art to provide such solutions which also is useable for all weights from light weights to heavy weights. Another problem is that the rotating grip in many prior art solutions has a play between the grip and the shaft, which makes the impression or "feeling" of the product as a product with poor quality. Especially dumbbells with slide bearings tend to get worn over time, which is a problem. Thus, it is a problem in prior art to provide a premium dumbbell with a "premium-feel", and with a thin grip design and which fits all weights from light weights up to heavy weights, and which is not impaired over time due to the normal handling during daily use.

SUMMARY OF THE INVENTION

It is an object of the invention to address at least some of the problems and issues outlined above. It is possible to achieve these objects and others by a dumbbell as defined in the attached independent claims.

According to an aspect of the invention, a dumbbell with a rotating grip is disclosed. The dumbbell comprises a shaft which extends along a longitudinal axis and which has a cross-sectional dimension. Further, a first dumbbell head is fixedly connected to a first end of the shaft and centered around the longitudinal axis of the shaft, and a second dumbbell head is fixedly connected to a second end of the shaft and also centered around the longitudinal axis of the shaft. The first dumbbell head comprises an inner side facing the second dumbbell head and an opposite outer side facing away from the second dumbbell head. The second dumbbell head comprises an inner side facing the first dumbbell head and an opposite outer side facing away from the first dumbbell head. Further, a tube-shaped hollow grip is arranged around the shaft and is centered around the longitudinal axis of the shaft. The grip has a first end and an opposite second end and an inner diameter and an outer diameter. The inner diameter of the grip is greater than the outer cross-sectional dimension of the shaft such as there is no contact between the grip and the shaft. A first ball bearing is centered around the longitudinal axis of the shaft, and an outer ring of the first ball bearing is connected to the first dumbbell head, and an inner ring of the first ball bearing is fixedly arranged to the first end of the hollow grip. Further, a second ball bearing is centered around the longitudinal axis of the shaft, and an outer ring of the second ball bearing is connected to the second dumbbell head, and an inner ring of the second ball bearing is fixedly arranged to the second end of the hollow grip.

By such an arrangement, a high end dumbbell with an ergonomic and user friendly design is achieved. The grip is as mentioned above, rotatable relative to the shaft and the dumbbell heads, and thereby the design of the dumbbell is gentle to the wrist. The overall design enables the use of a thinner grip, which fits most users and is able to use for all weights from light weights to heavy weights. Since the shaft is fixedly connected to the dumbbell heads, any shock force hitting the dumbbell, for example by a sudden drop of the dumbbell, only affects the dumbbell heads and the shaft, but hardly not at all, the rotating grip. This is far better than existing dumbbells and enables a longer life time of the dumbbell, and with remained high end feeling of the rotating grip. The rotating grip of prior art dumbbells is normally negatively affected by shock forces and the like, which is normal in the daily use of dumbbells, since there normally is contact between the shaft and the rotating grip in known solutions. Since the rotating grip is fixedly arranged to the inner rings of the ball bearings in the present solution, and the shaft is fixedly arranged to the dumbbell heads, the shaft as well as the grip may be rather thin, preferably with only a minimum of space between inside of the grip and the outside of the shaft. Thereby, the outside diameter of the grip may be for example 38 mm, and thereby fit most users. Prior art premium solutions, designed for use at all kinds of weights from say 5 kg up to 68 kg, have grips with outer diameter of about 50 mm, since the design is made such as the bearing is arranged between the grip and the shaft and sometimes with a rather thick shaft. In some prior art solutions with thin shaft design, the rotating grip is fitted around the shaft with a slide bearing between the grip and the shaft. Such solutions do not provide a premium feel and tends to be impaired over time since the slide bearing is worn out. With the inventive rotating, thin-grip design of the present dumbbell, the premium feel is not impaired over time and fits all dumbbells from low weights to high weights, even up to 68 kg which is not at hand in prior art dumbbells.

According to an embodiment, the inner ring of the first ball bearing and the inner ring of the second ball bearing respectively has an inner diameter which substantially corresponds with the outer diameter of the grip, such as the grip is fixedly arranged with its first end inside the inner ring of the first ball bearing and with its second end inside the inner ring of the second ball bearing. By the corresponding dimensions of the inner diameter of the ball bearings and the outer diameter of the grip, it is possible to get a robust fixation of the grip inside the bearings. And by fixedly fitting the ends of the grip inside the inner rings of the ball bearings and by that the inner diameter of the grip is slightly greater than the outer diameter of the shaft, the grip is not in contact with the shaft. Thereby, shock forces from a sudden drop of the dumbbell or a careless handling of the same, are taken care of by the dumbbell heads and the shaft and is not affecting the rotating grip that much. This is a far better solution compared to prior art.

According to an embodiment, the inner side of the first dumbbell head comprises a first cavity, which is centered around the longitudinal axis of the shaft. In the same way, the inner side of the second dumbbell head comprises a second cavity, which also is centered around the longitudinal axis of the shaft. The first cavity has an outer diameter which substantially corresponds with an outer diameter of the first ball bearing and the second cavity has an outer diameter which substantially corresponds with an outer diameter of the second ball bearing. This enables that the first ball bearing may be arranged in the first cavity and the second ball bearing may be arranged in the second cavity. To arrange the ball bearings into cavities in the dumbbell heads makes a smooth and nice design which doesn't impact on the grip and the space available for the hand.

According to an embodiment, the first dumbbell head is fixedly connected to the first end of the shaft by press fitting, and the second dumbbell head is fixedly connected to the second end of the shaft by press fitting. Thereby, a robust fixation of the dumbbell heads to the shaft is achieved, which gains power absorption from hits and shock forces and thus enables a longer life time compared to prior art.

According to an alternative embodiment, compared to fit the inner rings to the grip by any simple method as discussed above and which may be enough, the inner ring of the first ball bearing may be fixedly arranged to the first end of the hollow grip by press fitting, and the inner ring of the second ball bearing may fixedly arranged to the second end of the hollow grip by press fitting.

According to an embodiment, the first ball bearing is arranged in the first cavity by slip fitting, and the second ball bearing is arranged in the second cavity by slip fitting. This means that the ball bearing is precisely guided and fitted into the cavity and that there is contact between the walls of the cavity and the ball bearing. But the outer rings of the ball bearings are not pressed with high force into the cavity to make a totally solid or totally robust engagement between the outer ring of the ball bearing and the cavity walls. One reason for this is to avoid that the rings of the ball bearings are displaced during the assembly of the dumbbell, which might be a problem since the grip is fixedly fitted to the inner rings. Another reason to use slip fitting instead of for example press fitting when attaching the dumbbell heads to the outer rings of the ball bearing is to avoid a possible shock force transportation to the ball bearings and the grip from the dumbbell heads. But there is as said enough contact between the walls of the cavity and the outer ring, to make the grip rotate relative the dumbbell heads, but with no play and with remained premium-feel.

In a preferred embodiment, a first wave washer is arranged in the first cavity between a bottom of the first cavity and the first ball bearing and centered around the longitudinal axis of the shaft. In the same way, a second wave washer is arranged in the second cavity between a bottom of the second cavity and the second ball bearing and centered around the longitudinal axis of the shaft. Depending on tolerances in production of the dumbbell heads and its cavity as well as the tolerances of the ball bearings, a play may occur between the ball bearing and the cavity. To ensure that the eventual play between the cavity and the ball bearing is eliminated, the wave washer is arranged in the cavity.

According to an embodiment of the inventive dumbbell, the outer side of the first dumbbell head comprises a third cavity and the outer side of the second dumbbell head comprises a fourth cavity. Further, the first end of the shaft comprises an outer portion with a thread wherein the outer portion protrudes in the third cavity, and the second end of the shaft comprises an outer portion with a thread wherein the outer portion protrudes in the fourth cavity. By this, the first dumbbell head may be further secured to the first end of the shaft by a first nut engaged with the thread of the first end of the shaft, and in the same way, the second dumbbell head may be further secured to the second end of the shaft by a second nut engaged with the thread of the second end of the shaft.

According to an embodiment, the shaft is made of steel with a yield strength between 800-1000 $N/mm^2$ and a tensile strength of 1000-1400 $N/mm^2$. By using a high strength steel, the shaft may be designed with a small cross-section with remained strength suitable for all actual weights, but still with a grip with a thin cross-section.

According to an embodiment, the ball bearings are sealed low friction ball bearings. Thereby, the rotation of the grip is very easy, and the impact of the wrist is minimized. At the same time, the seal prevents dirt from entering into the ball bearing, which facilitates a simple and cost effective design where the ball bearing may have an exposed side facing the grip, without any cover plate or the like, thanks to the seal.

According to an embodiment, the first dumbbell head is fixedly connected to the first end of the shaft by a press fitting force of at least 100 kN, and the second dumbbell head is fixedly connected to the second end of the shaft by a press fitting force of at least 100 kN.

Further possible features and benefits of this solution will become apparent from the detailed description below.

BRIEF DESCRIPTION OF DRAWINGS

The solution will now be described in more detail by means of exemplary embodiments and with reference to the accompanying drawings, in which.

DETAILED DESCRIPTION

Briefly described, a high end dumbbell with an ergonomic and user friendly design with a long life time is disclosed.

Figure 1:
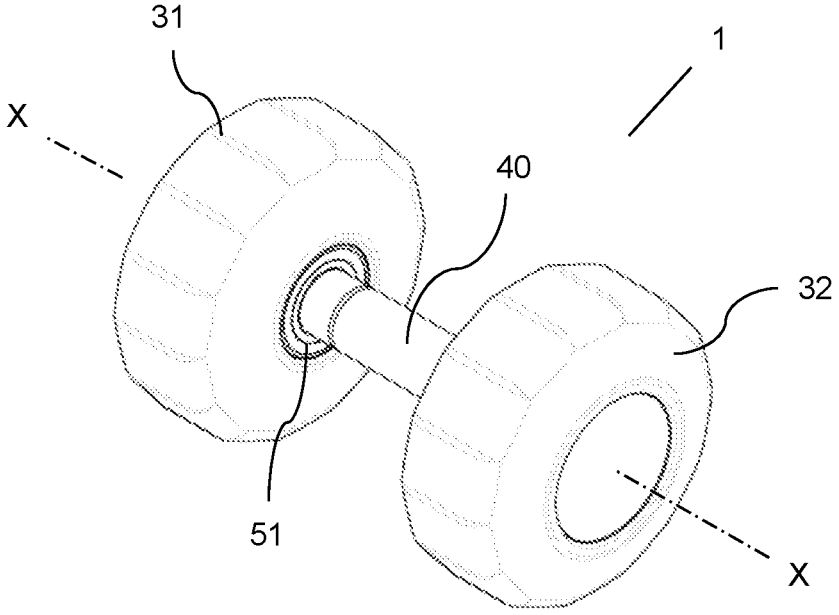
FIG. 1 is a perspective view of a dumbbell according to the invention.

FIG. 1 shows a perspective view of a dumbbell 1 according to the invention. The dumbbell 1 comprises a first dumbbell head 31 and a second dumbbell head 32 arranged on a respective side of a grip 40. The grip 40 is in turn arranged around a shaft 20 (not visible in FIG. 1), which shaft 20 extends along a longitudinal axis X-X. Visible in the figure is also a first ball bearing 51. The constructional design of the dumbbell 1 will be further explained below.

Figure 2:
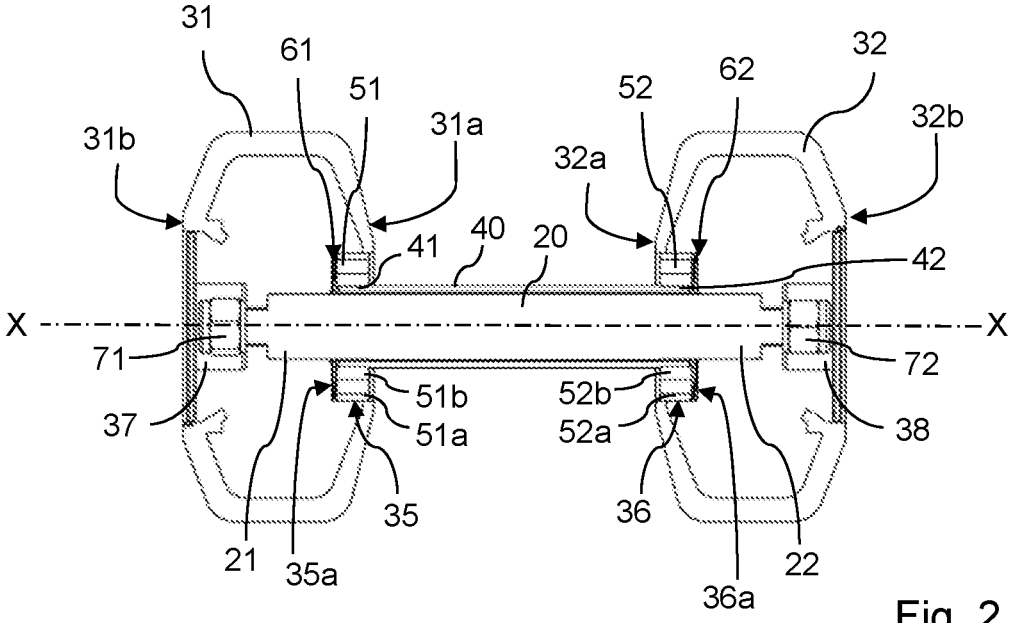
FIG. 2 is a longitudinal cross section of the dumbbell of FIG. 1.

FIG. 2 shows a longitudinal cross section of the dumbbell 1 of FIG. 1. As mentioned above, the dumbbell 1 comprises the shaft 20. The shaft 20 has a cross-sectional dimension $d_{s,outer}$, and extends, as mentioned above, along a longitudinal axis X-X (see also FIGS. 3 and 5). The shaft is made of steel with a yield strength between 800-1000 N/mm$^2$ and a tensile strength of 1000-1400 N/mm$^2$.

The first dumbbell head 31 is fixedly connected to a first end 21 of the shaft 20 and is centered around the longitudinal axis X-X of the shaft 20. The second dumbbell head 32 is fixedly connected to a second end 22 of the shaft 20 and is also centered around the longitudinal axis X-X of the shaft 20. The respective dumbbell heads 31, 32 is fixedly connected to the respective end 21, 22 by press fitting, preferably by a force of at least 100 kN. The first dumbbell head 31 comprises an inner side 31*a*, which faces the second dumbbell head 32, and an opposite outer side 31*b*, which faces away from the second dumbbell head 32. And in a similar way, the second dumbbell head 32 comprises an inner side 32*a*, which faces the first dumbbell head 31 and an opposite outer side 32*b*, which faces away from the first dumbbell head 32. Further, the inner side 31*a* of the first dumbbell head 31 comprises a first cavity 35 which is centered around the longitudinal axis X-X of the shaft 20, and in the same way the inner side 32*a* of the second dumbbell head 32 comprises a second cavity 36, also centered around the longitudinal axis X-X of the shaft 20.

The dumbbell 1 further comprises the first ball bearing 51 which is centered around the longitudinal axis X-X of the shaft 20. An outer ring 51*a* of the first ball bearing 51 is fixedly arranged to the first dumbbell head 31 by so-called slip fitting, which means that the first cavity 35 of the first dumbbell head 31 has an outer diameter $d_{c,\ outer}$ which corresponds with an outer diameter $d_{b,\ outer}$ of the first ball bearing 51, such as the first ball bearing 51 is exactly fitted into the first cavity 35. By that, there is contact between the outer ring 51*a* of the first ball bearing 51 and the walls of the cavity. In the same way, a second ball bearing 52 is centered around the longitudinal axis X-X of the shaft 20 and an outer ring 52*a* of the second ball bearing 52 is fixedly arranged to the second dumbbell head 32 by slip fitting, which means that the second cavity 36 of the second dumbbell head 32 has an outer diameter $d_{c,\ outer}$ which corresponds with an outer diameter $d_{b,\ outer}$ of the second ball bearing 52, such as the second ball bearing 52 is exactly fitted into the second cavity 36. See also FIG. 3.

The tube-shaped hollow grip 40 is arranged around the shaft 20 and the grip 40 is centered around the longitudinal axis X-X of the shaft 20. The grip 40 has a first end 41 and an opposite second end 42 and the grip 40 has an inner diameter $d_{g,\ inner}$ and an outer diameter $d_{g,\ outer}$ (see also FIG. 3). The inner diameter $d_{g,\ inner}$ of the grip 40 is greater than the outer cross-sectional dimension $d_{s,outer}$ of the shaft 20, such as there is no contact between the shaft 20 and the grip 40.

An inner ring 51*b* of the first ball bearing 51 is fixedly arranged to the first end 41 of the hollow grip 40, and an inner ring 52*b* of the second ball bearing 52 is fixedly arranged to the second end 42 of the hollow grip 40, in the same way. The method of fitting the inner rings 51*b*, 52*b* to the grip ends 41, 42 may vary and could for example be a manual fitting or press fitting or the like. To get a good and fixed attachment, the inner ring 51*b* of the first ball bearing 51 and the inner ring 52*b* of the second ball bearing 52, respectively has an inner diameter $d_{b,\ inner}$ which substantially corresponds with the outer diameter $d_{g,\ outer}$ of the grip 40, such as the grip 40 is fixedly connected with its first end 41 inside the inner ring 51*b* of the first ball bearing 51 and with its second end 42 inside the inner ring 52*b* of the second ball bearing 52.

To allow a certain tolerance at production of the dumbbell heads 31, 32 and the cavities 35, 36 therein, but eliminate a possible play between the ball bearings 51, 52 and the dumbbell heads 31, 32, a first wave washer 61 is arranged in the first cavity 35 between a bottom 35*a* of the first cavity 35 and the first ball bearing 51 and a second wave washer 62 is arranged in the second cavity 36 between a bottom 36*a* of the second cavity 36 and the second ball bearing 52. Both the first wave washer 61 and the second wave washer 62 are centered around the longitudinal axis X-X of the shaft 20. A wave washer is a washer with a wave-like form, arranged to allow a certain flexibility and act as a spring-force in the axial direction, and thereby eliminate the play between the ball bearings and the dumbbell heads.

The outer side 31*b* of the first dumbbell head 31 further comprises a third cavity 37 and the outer side 32*b* of the second dumbbell head 32 comprises a fourth cavity 38. These cavities 37, 38 are arranged to accommodate an extra security beyond that the press fitting fixation between the shaft 20 and the dumbbell heads 31, 32. To enable this, the first end 21 of the shaft 20 comprises an outer portion 21*a* with a thread, wherein the outer portion 21*a* protrudes in the third cavity 37 (see example FIG. 3), and the second end 22 of the shaft 20 also comprises an outer portion 22*a* with a thread, wherein the outer portion 22*a* protrudes in the fourth cavity 38. By that, the first dumbbell head 31 may be further secured to the first end 21 of the shaft 20 by a first nut 71, which is engaged with the thread of the first end 21 of the shaft 20. In a similar way, the second dumbbell head 32 may be further secured to the second end 22 of the shaft 20 by a second nut 72 engaged with the thread of the second end 22 of the shaft 20. In this way, a double security against loosened dumbbell heads is achieved.

Figure 3:
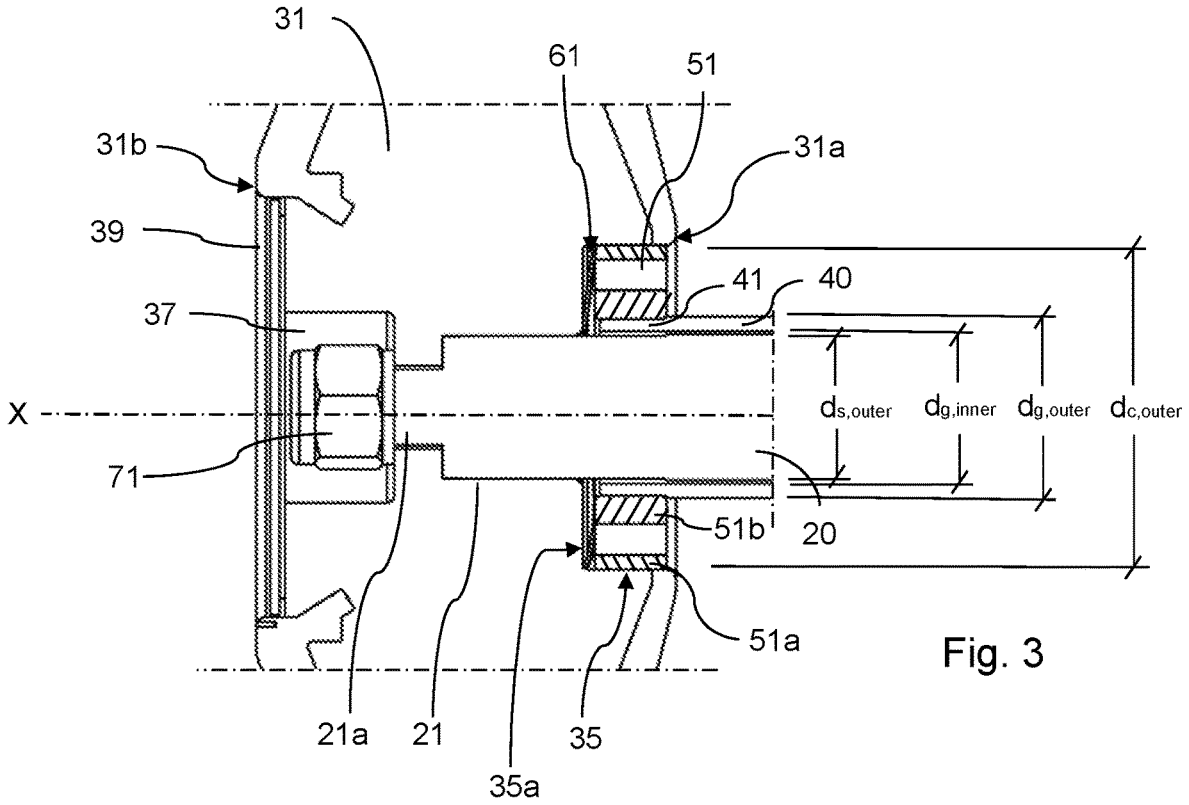
FIG. 3 is a zoomed view of the connection point between a dumbbell head, a shaft and a grip on the left side of the dumbbell of FIG. 1.

FIG. 3 is showing a zoomed view of the connection point between the first dumbbell head 31, the shaft 20 and the grip 40. As understood, the constructional design is similar also for the second dumbbell head 32 on the opposite side of the shaft 20. The first ball bearing 51 is fitted to the first end 41 of the grip 40 by that the inner ring 51*b* of the first ball bearing 51 has an inner diameter $d_{b,\ inner}$ which substantially corresponds with the outer diameter $d_{g,\ outer}$ of the grip 40. Since the first ball bearing 51 is fixed in the longitudinal direction, it is only needed, but also an advantage, to only fit the first ball bearing 51 into the cavity 35 by slip fitting. As told earlier, slip fitting means a close to precise fit between the outer ring 51*a* of the first ball bearing 51 and the wall of the first cavity 35, but they are not pressed together as one "solid" unit, instead the first ball bearing 51 is slipped into the first cavity 35, but with very precise fit. This means that the grip 40 with the ball bearings 51, 52 is free rotating relative the dumbbell heads 31, 32 as well as relative the shaft 20, but with no detectable (sensed) play between the grip and the dumbbell heads 31, 32, which gives a premium feel for the product. The high performance steel and the solid fixation between the shaft 20 and the dumbbell heads 31, 32 takes care of the weight of the dumbbell heads 31, 32 and all possible shocks and forces caused by for example a drop of the dumbbell 1 on the ground. The ball bearings 51, 52 are less affected or worn by this why a good quality over time is achieved. As mentioned earlier, the inner diameter $d_{g,\ inner}$ of the grip 40 is greater than the outer cross-sectional dimension $d_{s,\ outer}$ of the shaft 20, such as there is no contact between the shaft 20 and the grip 40, why this effect is achieved. Visible in the figure is also the first wave washer 61, which is arranged in the first cavity 35 between the bottom 35*a* of the first cavity 35 and the first ball bearing 51, to ensure that any possible play is not sensed, as explained above. Visible in the zoomed figure is also the first nut 71, engaged with the thread of the outer portion 21*a* of the first end 21 of the shaft 20, and accessible from the third cavity 37 of the first dumbbell head 31. The outer side 31*b* of the first dumbbell head 31 also comprises a protective end cap 39 which protects the third cavity 37 and also provides a design area, preferably arranged for a printed logo or the like.

Figure 4:
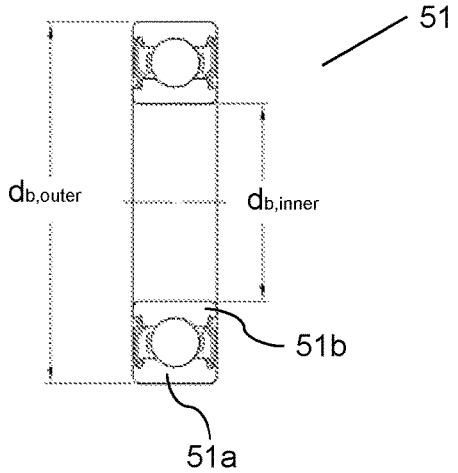
FIG. 4 is a cross-section of a ball bearing used in the dumbbell of FIG. 1.

FIG. 4 is a cross-section of first ball bearing 51 of FIGS. 2 and 3, and it is understood that the second ball bearing 52 is of the same kind. The first ball bearing 51 is preferably a sealed low-friction ball bearing of standard type, with the outer diameter $d_{b,\ outer}$ of the outer ring 51*a* and the inner diameter $d_{b,\ inner}$ of the inner ring 51*b*.

Figure 5:
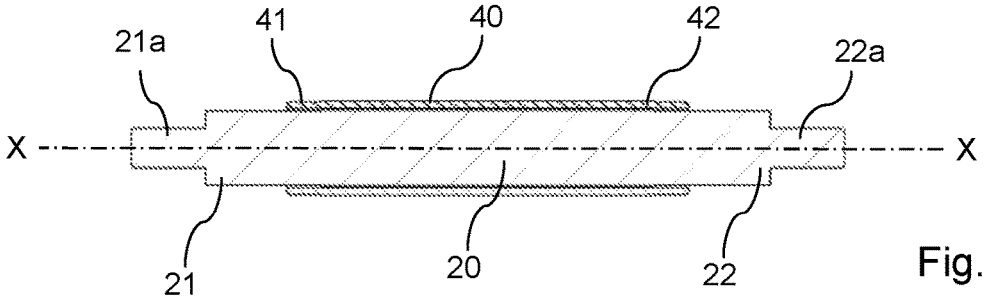
FIG. 5 is a cross-section of a shaft with a grip arranged on the outside of the shaft, of the dumbbell of FIG. 1.

FIG. 5 is a cross-section of the shaft 20 with the grip 40 arranged on the outside of the shaft 20 and extending along the longitudinal axis X-X of the shaft. The grip 40 is arranged around the middle part of the shaft 20, so that the first end 21 and the second end 22 of the shaft are free for the press fitting fixation of the shaft ends 21, 22 to the respective dumbbell head 31, 32. The length of the grip 40 extends between the first end 41 and the second end 42 of the shaft 40 and corresponds substantially to the distance between the two dumbbell heads, such as the first and second ends 41, 42 fits inside the respective ball bearing 51, 52. The thread of the respective outer portion 21*a*, 22*a* is not visible in the figure.

Although the description above contains a plurality of specificities, these should not be construed as limiting the scope of the concept described herein but as merely providing illustrations of some exemplifying embodiments of the described concept. It will be appreciated that the scope of the presently described concept fully encompasses other embodiments which may become obvious to those skilled in the art, and that the scope of the presently described concept is accordingly not to be limited. Reference to an element in the singular is not intended to mean "one and only one" unless explicitly so stated, but rather "one or more." All structural and functional equivalents to the elements of the above-described embodiments that are known to those of ordinary skill in the art are expressly incorporated herein and are intended to be encompassed hereby.

The invention claimed is:

1. A dumbbell comprising:

a shaft having an outer cross-sectional dimension, and extending along a longitudinal axis, a first dumbbell head fixedly connected to a first end of the shaft and centered around the longitudinal axis of the shaft, a second dumbbell head fixedly connected to a second end of the shaft and centered around the longitudinal axis of the shaft, and the first dumbbell head comprises an inner side facing the second dumbbell head and an opposite outer side facing away from the second dumbbell head, and the second dumbbell head comprises an inner side facing the first dumbbell head and an opposite outer side facing away from the first dumbbell head, a tube-shaped hollow grip arranged around the shaft and centered around the longitudinal axis of the shaft, the grip having a first end and an opposite second end, and an inner diameter and an outer diameter, wherein the inner diameter of the grip is greater than the outer cross-sectional dimension of the shaft, a first ball bearing centered around the longitudinal axis of the shaft, wherein an outer ring of the first ball bearing is connected to the first dumbbell head, and an inner ring of the first ball bearing is fixedly arranged to the first end of the hollow grip, a second ball bearing centered around the longitudinal axis of the shaft, wherein an outer ring of the second ball bearing is connected to the second dumbbell head, and an inner ring of the second ball bearing is fixedly arranged to the second end of the hollow grip, and wherein the inner side of the first dumbbell head comprises a first cavity centered around the longitudinal axis of the shaft, and the inner side of the second dumbbell head comprises a second cavity centered around the longitudinal axis of the shaft, wherein the first cavity has an outer diameter which corresponds with an outer diameter of the first ball bearing and the second cavity has an outer diameter which corresponds with an outer diameter of the second ball bearing, and the first ball bearing is arranged in the first cavity and the second ball bearing is arranged in the second cavity, and wherein the first ball bearing is arranged in the first cavity by slip fitting, and the second ball bearing is arranged in the second cavity by slip fitting, wherein each slip fitting is a mechanical interface between the corresponding ball bearing and cavity characterized by an exact fit of the ball bearing into the cavity and is not a press fit between the ball bearing and the cavity.

2. The dumbbell according to claim 1, wherein the inner ring of the first ball bearing and the inner ring of the second ball bearing respectively has an inner diameter which corresponds with the outer diameter of the grip, such that the grip is fixedly arranged with its first end inside the inner ring of the first ball bearing and with its second end inside the inner ring of the second ball bearing.

3. The dumbbell according to claim 1, wherein the first dumbbell head is fixedly connected to the first end of the shaft by press fitting, and the second dumbbell head is fixedly connected to the second end of the shaft by press fitting.

4. The dumbbell according to claim 1, wherein the inner ring of the first ball bearing is fixedly arranged to the first end of the hollow grip by press fitting, and the inner ring of the second ball bearing is fixedly arranged to the second end of the hollow grip by press fitting.

5. The dumbbell according to claim 1, wherein a first wave washer is arranged in the first cavity between a bottom of the first cavity and the first ball bearing and centered around the longitudinal axis of the shaft, and a second wave washer is arranged in the second cavity between a bottom of the second cavity and the second ball bearing and centered around the longitudinal axis of the shaft.

6. The dumbbell according to claim 1, wherein the outer side of the first dumbbell head comprises a third cavity and the outer side of the second dumbbell head comprises a fourth cavity, and the first end of the shaft comprises an outer portion with a thread wherein the outer portion protrudes in the third cavity, and the second end of the shaft comprises an outer portion with a thread wherein the outer portion protrudes in the fourth cavity, and the first dumbbell head is further secured to the first end of the shaft by a first nut engaged with the thread of the first end of the shaft, and the second dumbbell head is further secured to the second end of the shaft by a second nut engaged with the thread of the second end of the shaft.

7. The dumbbell according to claim 1, wherein the shaft is made of steel with a yield strength between 800-1000 $N/mm^2$ and a tensile strength of 1000-1400 $N/mm^2$.

8. The dumbbell according to claim 1, wherein the ball bearings are sealed low friction ball bearings.

9. The dumbbell according to claim 3, wherein the first dumbbell head is fixedly connected to the first end of the shaft by a press fitting force of at least 100 kN, and the second dumbbell head is fixedly connected to the second end of the shaft by a press fitting force of at least 100 kN.

10. The dumbbell according to claim 1, wherein each of the first dumbbell head and the second dumbbell head provide weight to the dumbbell that, combined with weight of the shaft, grip and first and second ball bearings, achieve a desired weight of the dumbbell.

11. The dumbbell according to claim 10, wherein the fixed connection between each of the first dumbbell head and the second dumbbell head and the shaft are press fittings.

* * * * *